US010196947B2

(12) United States Patent
LeRoy

(10) Patent No.: US 10,196,947 B2
(45) Date of Patent: Feb. 5, 2019

(54) MUFFLER

(71) Applicant: Kohler Co., Kohler, WI (US)

(72) Inventor: Tyler W. LeRoy, Plymouth, WI (US)

(73) Assignee: Kohler Co., Kohler, WI (US)

( * ) Notice: Subject to any disclaimer, the term of this patent is extended or adjusted under 35 U.S.C. 154(b) by 0 days.

(21) Appl. No.: 15/409,173

(22) Filed: Jan. 18, 2017

(65) Prior Publication Data

US 2017/0218806 A1 Aug. 3, 2017

Related U.S. Application Data

(60) Provisional application No. 62/290,129, filed on Feb. 2, 2016.

(51) Int. Cl.
*F01N 1/02* (2006.01)
*F01N 1/08* (2006.01)
(Continued)

(52) U.S. Cl.
CPC ..... *F01N 1/083* (2013.01); *F01N 1/023* (2013.01); *G10K 11/04* (2013.01); *G10K 11/161* (2013.01);
(Continued)

(58) Field of Classification Search
CPC ..... F01N 1/003; F01N 1/006; F01N 1/026; F01N 1/084; F01N 1/089; F01N 2470/02;
(Continued)

(56) References Cited

U.S. PATENT DOCUMENTS 2,196,491 A * 4/1940 Chipley ..... F01N 1/089 181/231
2,520,756 A * 8/1950 Bryant ..... F01N 1/003 181/232
(Continued)

FOREIGN PATENT DOCUMENTS

CN 1903639 A 1/2007
CN 202707196 U 1/2013
(Continued)

OTHER PUBLICATIONS

European Office Action 03222018, European Office Action in corresponding European Patent Application No. 7153933.1; dated Mar. 22, 2018; 5 pages.
(Continued)

*Primary Examiner* — Edgardo San Martin
(74) *Attorney, Agent, or Firm* — Lempia Summerfield Katz LLC

(57) ABSTRACT

A muffler includes a first chamber, a second chamber, an extender tube, a reverse flow tube, and a separation chamber. The first chamber is coupled to an exhaust inlet of the muffler. The extender tube is coupled to the first chamber and the second chamber. The exhaust gas flows from the first chamber to the second chamber through the extender tube in a first direction. The reverse flow tube coupled to the second chamber. The exhaust gas flows through the second chamber from the extender tube to the reverse flow tube in a second direction different than the first direction. The separation chamber that provides spatial separation between the first and second chamber.

20 Claims, 15 Drawing Sheets

(51) Int. Cl.
*G10K 11/04* (2006.01)
*G10K 11/16* (2006.01)
*F01N 1/00* (2006.01)

(52) U.S. Cl.
CPC ..... *F01N 2470/02* (2013.01); *F01N 2470/18* (2013.01); *F01N 2490/02* (2013.01)

(58) Field of Classification Search
CPC ..... F01N 2470/18; F01N 2490/02; F01N 2490/04; F01N 2490/06
See application file for complete search history.

(56) References Cited

U.S. PATENT DOCUMENTS 2,553,306 A * 5/1951 Dietrich ..... F02M 35/14 181/231
2,809,709 A * 10/1957 Billey ..... F01N 1/003 181/266
2,985,252 A * 5/1961 Morrish ..... F01N 1/02 181/239
3,703,938 A * 11/1972 Nelson ..... F01N 1/084 181/274
3,853,201 A * 12/1974 Smale ..... B62M 27/02 181/265
4,006,793 A * 2/1977 Robinson ..... F01N 1/00 181/266
4,203,502 A * 5/1980 Strader ..... F01N 1/08 181/238
4,341,284 A * 7/1982 Moore ..... F01N 1/00 181/272
4,381,045 A * 4/1983 Buchwalder ..... F01N 1/084 181/265
5,376,341 A * 12/1994 Gulati ..... F01N 1/084 422/179
5,979,583 A * 11/1999 Amino ..... F01N 1/08 180/219
5,984,045 A 11/1999 Maeda et al.
6,241,044 B1 * 6/2001 Nishiyama ..... F01N 1/083 181/227
7,681,690 B2 * 3/2010 Roberts ..... B25D 17/12 181/230
7,934,583 B2 * 5/2011 Reuther ..... F01N 1/00 181/227
8,172,039 B2 * 5/2012 Park ..... F01N 1/003 181/239
8,205,713 B2 * 6/2012 Gorke ..... F01N 13/1838 181/212
8,205,716 B2 * 6/2012 Wirth ..... F01N 1/08 181/212
8,579,077 B2 * 11/2013 Ahn ..... F01N 13/08 181/212
2005/0115764 A1 6/2005 Mabuchi et al.
2006/0037814 A1 2/2006 Mabuchi et al.
2007/0051556 A1 3/2007 Bogard
2009/0000282 A1 1/2009 Gruber
2009/0032332 A1 * 2/2009 Reuther ..... F01N 1/00 181/227
2011/0272209 A1 11/2011 Tauschek et al.
2015/0330283 A1 11/2015 Carr et al.

FOREIGN PATENT DOCUMENTS

CN 203730098 U 7/2014
CN 104234806 A 12/2014
CN 105386814 A 3/2016
CN 205370688 U 7/2016
EP 2196640 B1 10/2014
GB 139369 A 3/1920
JP S5872410 5/1983
JP 61185611 A * 8/1986

OTHER PUBLICATIONS

My Wanna Do Exhaust Project, AquilaBMW. Source: http://www.bimmerforums.com/forum/showthread.php?1857693-My-Wanna-Do-Exhaust-Project. Publication Date: Jun. 29, 2012. Date Accessed: Jan. 8, 2017.
European Search Report for European Application No. 17153933.1-1616, dated Jun. 14, 2017.
Chinese Office Action for Chinese Patent Application No. 201710060422.1, dated Oct. 19, 2018.

* cited by examiner

MUFFLER

This application claims priority benefit of Provisional Application No. 62/290,129 filed Feb. 2, 2016, which is hereby incorporated by reference in its entirety.

FIELD

This disclosure relates in general to a combustion noise suppression process or system for an internal combustion engine.

BACKGROUND

An internal combustion engine, as well as other devices, produce unwanted acoustic waves or noise. The combustion of air and fuel creates noise. The operation of pistons, crankshafts, gears, belts and pulleys creates noise. A muffler, which may also be referred to as a silencer, provides structure for reducing the noise or magnitude of the acoustic waves. The muffler may include materials that partially absorb the acoustic waves. The muffler may include structure that introduces destructive interference to reduce the magnitude of the acoustic waves. Challenges remain in maximizing the reduction in noise or magnitude of acoustic waves produced by the internal combustion engine.

BRIEF DESCRIPTION OF THE DRAWINGS

Exemplary embodiments are described herein with reference to the following drawings.

DETAILED DESCRIPTION

Figure 1:
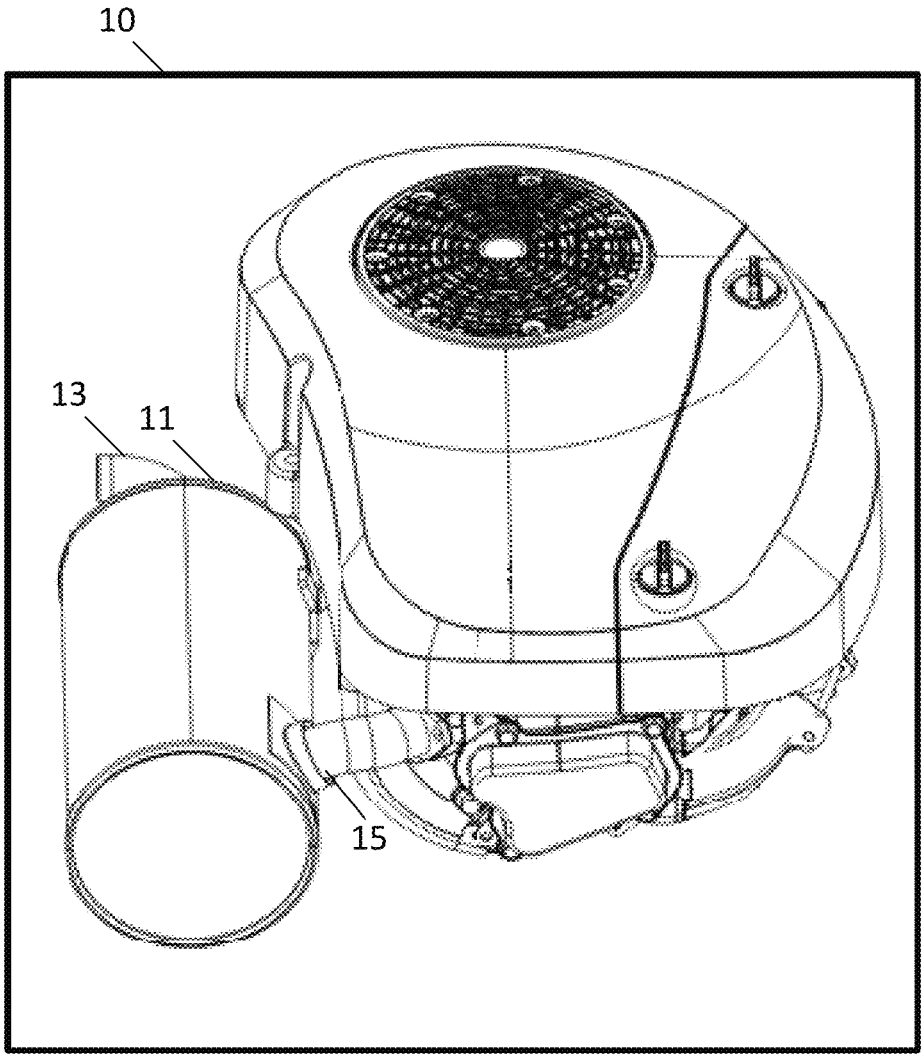
FIG. 1 illustrates an engine including a muffler.

FIG. 1 illustrates an engine 10 including a muffler 11 or silencer. An input pipe or tube 15 of the muffler 11 delivers exhaust gas from the engine to the muffler 11. As a valve connecting the engine 10 and the input tube opens, an acoustic pressure wave generated from combustion is propagated through the inlet pipe. The muffler 11 helps to reduce the combustion generated sound waves through geometry that causes acoustic pressure cancelation through impedance mismatch from muffler geometry features. The exhaust gas continues out from the muffler 11 through the output pipe or tube 13. The partial cancellation of one sound wave upon another may be referred to as destructive interference and result in transmission loss. The transmission loss is a parameter that describes the acoustic attenuation capacity of the muffler. The transmission loss parameter may not take into account the source strength, source impedance, or termination impedance. As a result, the transmission loss parameter may not be equivalent to the sound reduction (e.g., sound reduction in dB) of the engine noise, but the transmission loss parameter may be a close indicator of the sound reduction in the engine noise. In one example, insertion loss, may describe the sound reduction on a frequency basis. The transmission loss or the insertion loss may be a metric to measure the effect of the muffler 11 in reducing the noise of the engine 10.

The engine 10 may be a small internal combustion engine defined according to a displacement of the engine 10 or a volume of the muffler 11. The volume of the muffler may be 50-400 cubic inches or another size. The volume of the engine 10 may be 10 to 65 cubic inches or another size. Example lengths for the muffler 11 may be 4 to 14 inches (e.g., 12 inches) or another value, and example diameters for the muffler 11 may be 3 to 6 inches or another value. The small internal combustion engine may be applicable to chainsaws, lawn mowers, wood chippers, stump grinders, concrete trowels, mini excavators, concrete saws, portable saw mills, weed trimmers, all-terrain vehicles, wood splitters, pressure washers, garden tillers, tractors, plows, snow blowers, welding equipment, generators, and other devices.

The engine 10 may include one cylinder, two cylinders or another number of cylinders. The one or more cylinders may generate noise or sound waves as a result of the oscillations of one or more pistons through the one or more cylinders, which are shaped to receive the one or more pistons. The one or more pistons may be guided through the one or more cylinders by a connecting rod that is connected to a crankshaft by a crankpin. A combustion chamber includes a combustion chamber adjacent to a head of the piston. The combustion chamber is formed in a cylinder head. The combustion chamber is connected to the muffler 11 through an exhaust port. In one phase of a combustion cycle for the piston, the exhaust port is blocked from the combustion chamber by an exhaust valve, and in a subsequent phase, the exhaust port is in gaseous connection with the combustion chamber to release exhaust gas through the exhaust port to the muffler 11.

The combustion cycle may also generate noise or sound waves that travel to the muffler through the cylinder head or housing or through the exhaust port. The connecting road and crankpin may generate noise or sounds waves that travel to the muffler 11. The engine 10 may include other sources of noise or sounds waves including a gearing system, a valve-train system (including valves hitting seats), an intake system including a manifold, a fuel supply, a speed governor, a cooling system, an exhaust system, a lubrication system, and a starter system.

The sound waves that travel through the muffler 11 and are attenuated by the muffler 11 may be classified as low frequency sound waves and mid to high frequency sound waves. In other examples three classifications may be used such as low frequency, middle frequency, and high frequency. The low frequency sound waves may be in a first range and the high frequency sound waves may be in a second range. Examples for the low frequency range may be less than 500 hertz or 40 to 400 hertz. Examples for the high frequency range may be 500 to 5000 hertz or 1 kHz to 10 kHz. The sounds in the low frequency range may be produced by the mechanical components of the engine 10. The low frequency range may be dominated by combustion noise produced in the engine 10. The low frequency range may be dependent on the number of cylinders of the engine 10. The sounds in the high frequency range may be exhaust noise produced by the gas flows through the muffler 11. The exhaust noise may be caused by turbulent flow in the gas flows or interaction of the gas flows interacting with surfaces within the engine 10. The turbulent flows include changes in pressure and velocity within the gas flows. Aerodynamic forces create noise from the gas flow when the gas flows change direction or velocity in response to fluid mechanics of the gas flows flowing over or against external structure such as edges or surfaces. The sounds in the high frequency range may also include sound waves produced by an exhaust related device such as a turbocharger, a super charger, or an after cooler. In many examples, combustion noise dominates the low frequency range and exhaust noise dominates the mid to high frequency range, but other examples are possible.

Sensors may be located at various locations in the engine 10 including the cylinders, manifold, a cooling system, and exhaust. Data collected by the sensors may be analyzed by a controller to generate a command to adjust one or more passages (e.g., actuate a valve) in the muffler 11. Data collected by the sensors may be analyzed by the controller to determine noise levels or a frequency range for the noise levels.

The phrases "coupled with" or "coupled to" include directly connected to or indirectly connected through one or more intermediate components. Additional, different, or fewer components may be provided. Additional, different, or fewer components may be included.

The housing of the muffler 11 may be formed from a metal such as steel and may include any combination of a sound absorbing material, a ferrous material, or an anti-corrosion material. Example materials include ferrous alloys, aluminum, aluminized steel, titanium alloys, and ceramics. Ferrous materials may be particularly resistance to the heat expelled by the engine 10. Anti-corrosion materials may prevent rust or other corrosion, which may be caused by any combination of water, salt, or other environmental conditions placed on the engine 10 and muffler 11.

Figure 2:
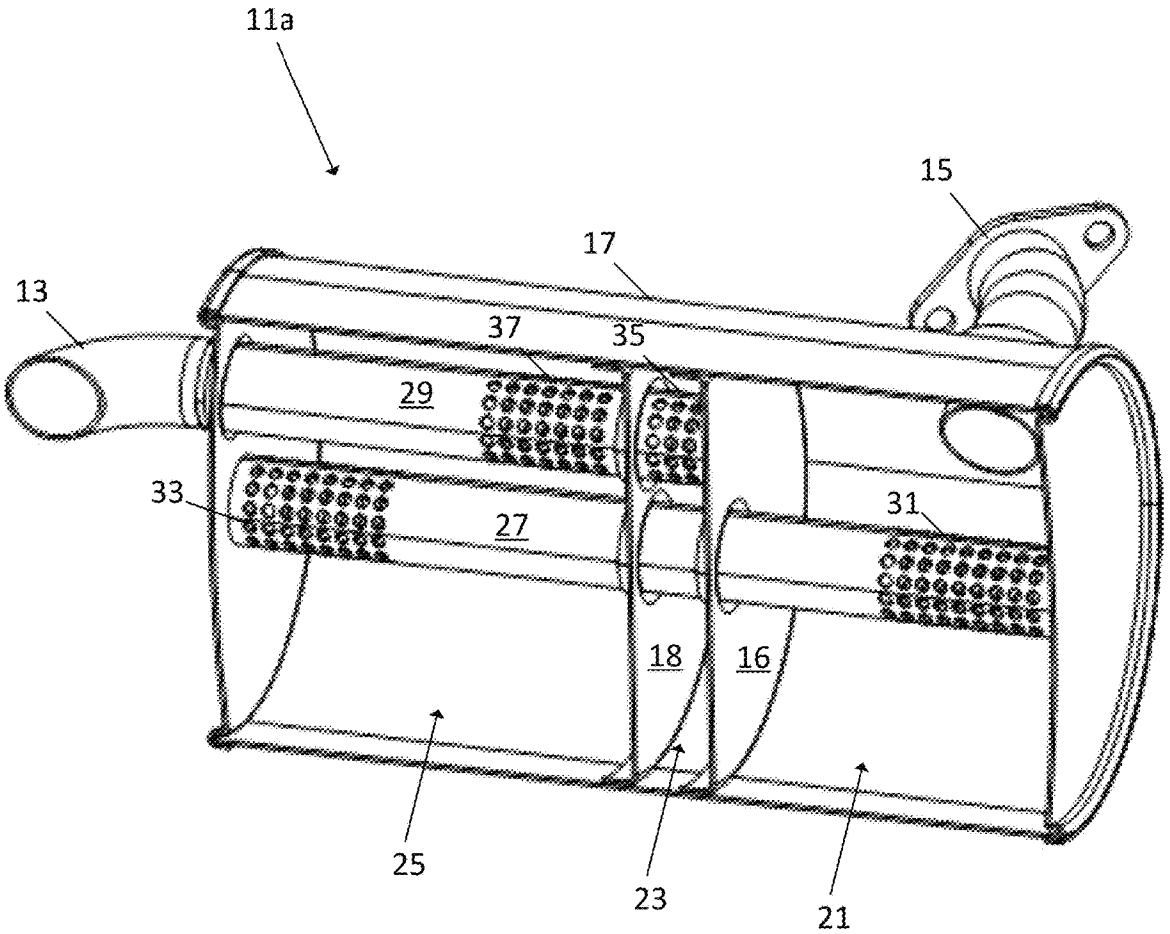
FIG. 2 illustrates an example muffler according to a first embodiment.

FIG. 2 illustrates an example muffler 11*a*, which includes an input pipe 15, an output pipe 13, and a housing 17 or canister. The muffler is illustrated as cylindrical but may also be oval, octagonal, rectangular, or another shape in cross section. The housing 17 includes at least three chambers, a first chamber 21, a second chamber 25, and a third chamber 23. The third chamber 23 is a spatial separation between the first chamber 21 and the second chamber 25. Additional chambers may be included.

As described in more detail in other embodiments, exhaust gases may be present in the third chamber 23 or the third chamber 23 may be blocked off entirely and used specifically for spatial separation between the first chamber 21 and the second chamber 25.

Figure 3:
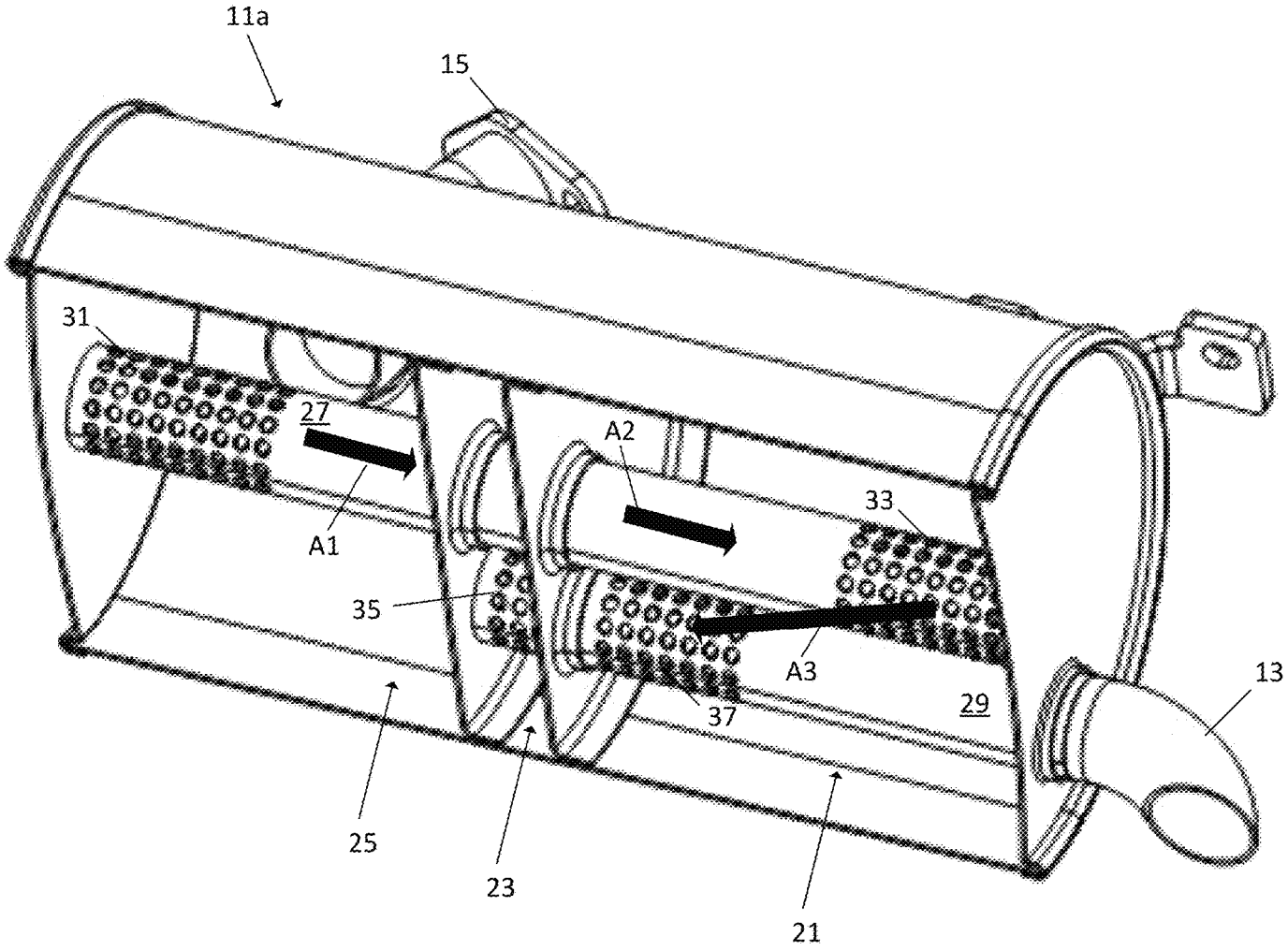
FIG. 3 illustrates another example muffler according to the first embodiment.

A first baffle 16 divides the first chamber 21 and the third chamber 23, and a second baffle 18 divides the third chamber 23 and the second chamber 25. A first tube 27 (e.g., canister length tube) traverses the first chamber 21, the third chamber 23, and the second chamber 25. A second tube 29 (e.g., partial length tube) traverses the second chamber 25 and the third chamber 23. The first tube 27 includes a first group of perforations 31 on the input side in the first chamber 21 and a second group of perforations 33 on the output side in the second chamber 25. The second tube 29 includes a first group of perforations 35 in the third chamber 23 and a third group of perforations 37 on the adjacent side in the second chamber 25. The perforations are holes in the tubing. The first group of perforations 35 may be omitted. In some examples, exhaust gases may flow from the second chamber 25 to the third chamber 23. Additional, different or fewer components may be included. FIG. 3 illustrates another view of the muffler 11*a* including arrows A1-A3 indicative of the flow of exhaust gases.

In operation, exhaust gas flows into the first chamber 21 from the input pipe 15 and then through the first tube 27 into the second chamber 25, as shown by arrows A1 and A2. The first tube 27 may not be connected to the input pipe 15, which has several advantages. Some of the advantages relates to the cost and ease of manufacturing the first tube 27. A tube that does not bend to connect to the input pipe 15 does not require the step of bending. In addition, the tube requires less material than a longer tube that bends to connect to the input pipe 15.

Some of the advantages relate to the attenuation of sound. The high frequency exhaust flow noise may be caused by pulses of air from the combustion cycle of the engine 10. Because the gas collects in first chamber 21 before flowing into the first tube 27, the first chamber 21 acts as a damper to smooth out the amplitude of the pulses of the exhaust flow noise. That is, the impact of each pulse is spread out over time as the first chamber 21 fills with gas and flows into the first tube 27.

The exhaust gas does not flow into the third chamber 23 from the first tube 27, which increases the distance of the path of the exhaust gas flows. Exhaust gases may flow from the second group of perforations 33 to fill, at least in part, the second chamber 25 and provide exhaust gases through the third group of perforations 37 to the second tube 29, in a direction shown by arrow A3.

The third chamber 23 may be sealed from the first chamber 21, the second chamber 25, or both. The third chamber 23 may be sealed from the rest of the muffler. The third chamber 23 may be sealed from the exhaust system and the exterior of the muffler. In some example, insubstantial amounts of the exhaust gas may flow into the third chamber 23 due to gaps in the construction of the muffler 11*a*.

A dimension of the third chamber 23 is selected according to the frequency spectrum of the engine 10. That is, the engine 10 may produce sounds of different frequency depending on the size and shape of the engine 10, the application of the engine 10, the running revolutions per minute (RPM) that the engine 10 is likely operated at, the loading on the engine, or the RPM when the engine 10 is idling. The frequency spectrum may be dependent on the number of cylinders in the engine 10. One or more dimensions of the housing 17 may be calculated as a fraction of a wavelength of a frequency selected from the frequency spectrum. The selected frequency may be a harmonic of the frequency spectrum. In one example, the dimensions of the housing 17 may be selected according to the frequency spectrum of the engine 10.

The dimension of the third chamber 23 may be a length of the third chamber 23 in the longitudinal direction of the muffler 11*a*. Example widths may include ½ inch, 1 inch, 2 inches, or another value. The width of the third chamber 23 may be selected according to the overall length of the muffler 11*a*. The length of third chamber 23 may be a fraction of the length of the muffler 11*a*. The length of the third chamber 23 may be less than ⅓ (one third) of the overall length of the muffler 11*a*. The length of the third chamber 23 may be less than ⅙ (one sixth) of the overall length of the muffler 11*a*. Examples of fractions or ratios between the length of the third chamber 23 and the overall length of the muffler 11*a* may include ⅛, 1/12, or 1/20.

The length of the third chamber 23 may be open space filled with air. The length of the third chamber 23 may include a fill material such as foam, rubber or plastic. The length of third chamber may include a conductive material such as metal (e.g., steel). The conductive material may be multiple plates of material coupled together. The dimension of the third chamber 23 may be a thickness of the baffles 16 and 18. In one alternative, the third chamber 23 is selected by volume. Example volumes include 5-20 cubic inches.

Figure 6:
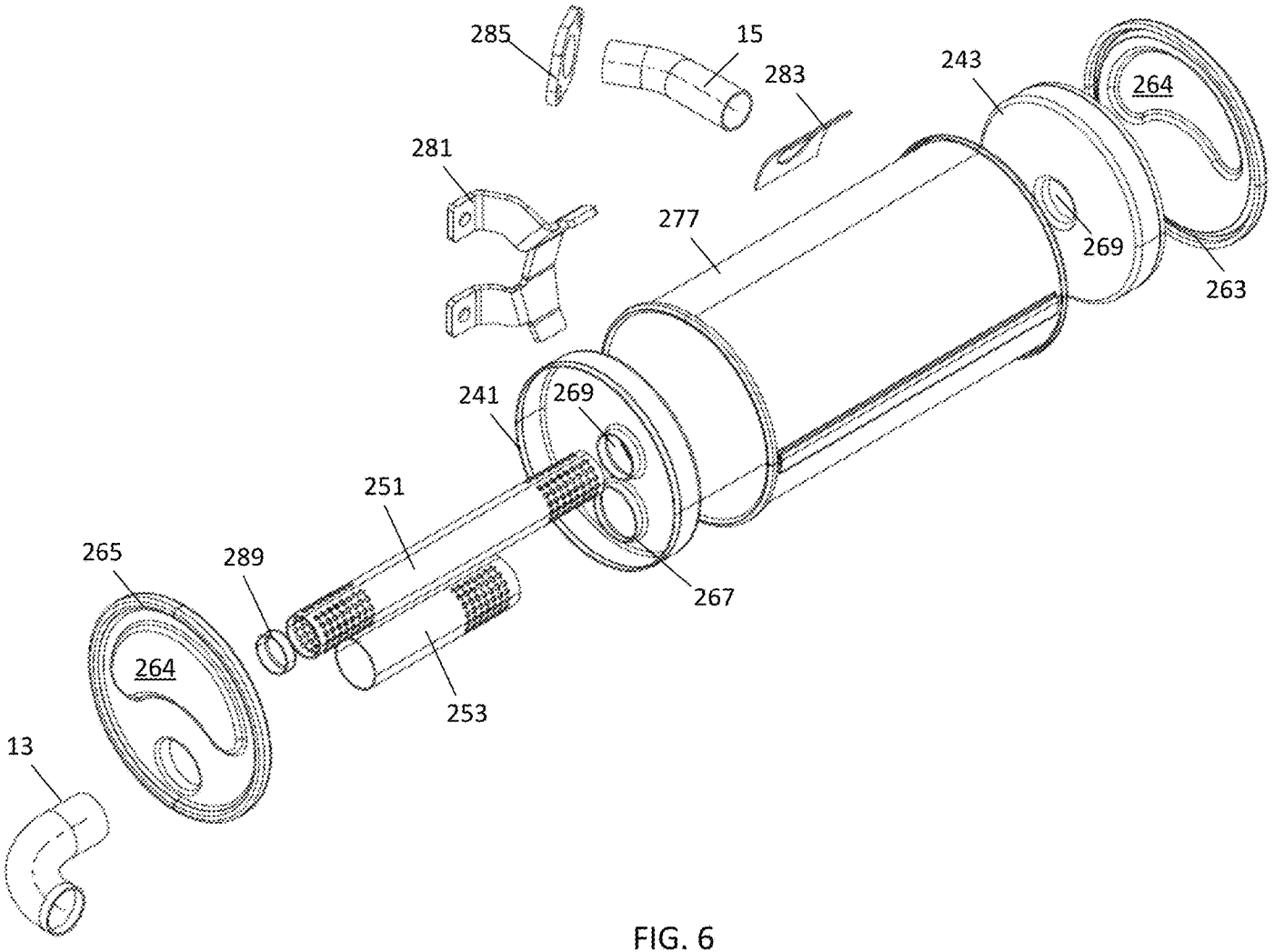
FIG. 6 illustrates an example muffler according to a third embodiment.

The first tube 27 extended through the first chamber 21 and second chamber 25 improves the low frequency performance effect from the first chamber 23 in attenuated sound waves in the low frequency range. Third chamber 23 provides an impedance mismatch between the first chamber 21 and the second chamber 25. The third chamber 23 causes some of the sound waves to reflect back to chamber 21 and some of the sound wave to be transmitted to the second chamber 25. By having a spatial separation of the first chamber 21 to the second chamber 25, given by the length of the third chamber 23, the acoustic transmission loss performance can be greatly improved in the lower frequency range. FIG. 6, described in more detail below, illustrates how the length of this third chamber 23 shifts the transmission loss curve to a lower frequency while greatly improving the attenuation capacity.

Figure 4:
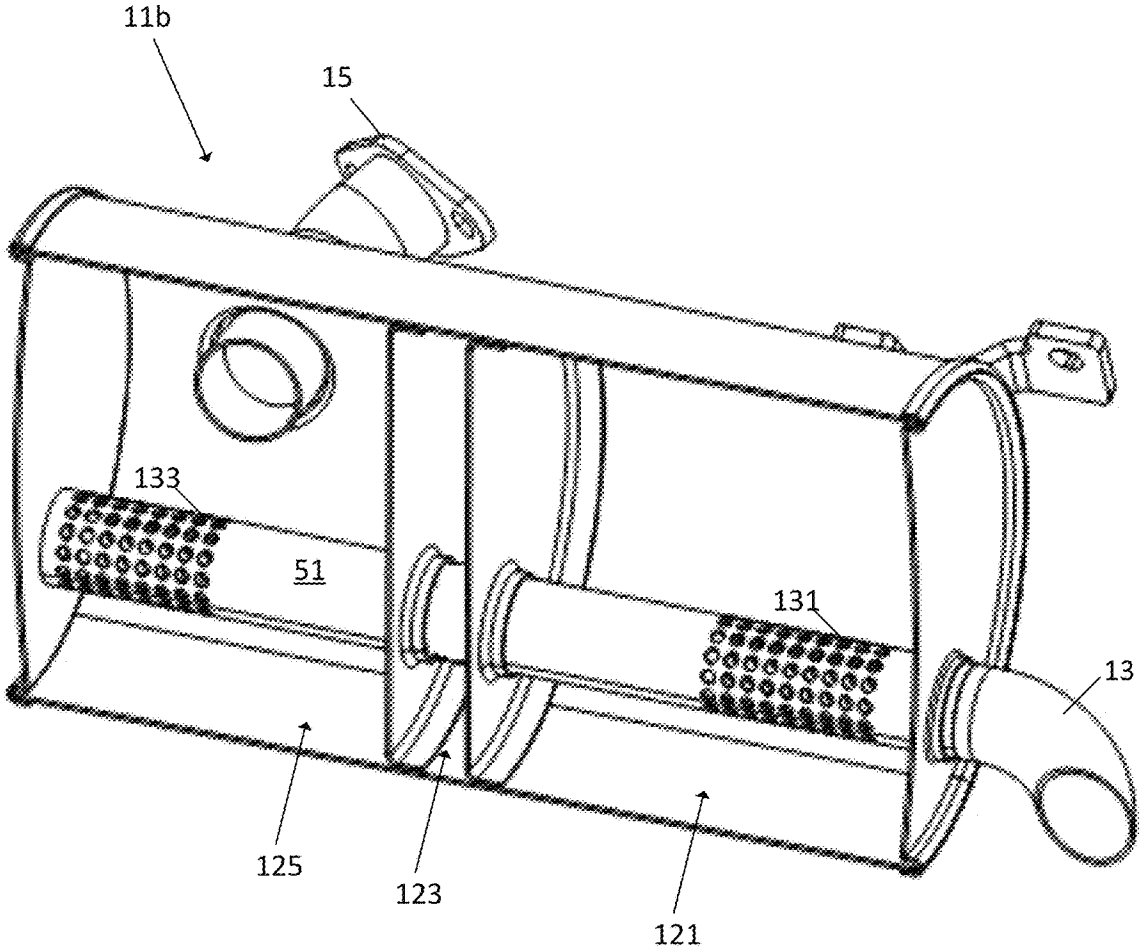
FIG. 4 illustrates an example muffler according to a second embodiment.
Figure 5:
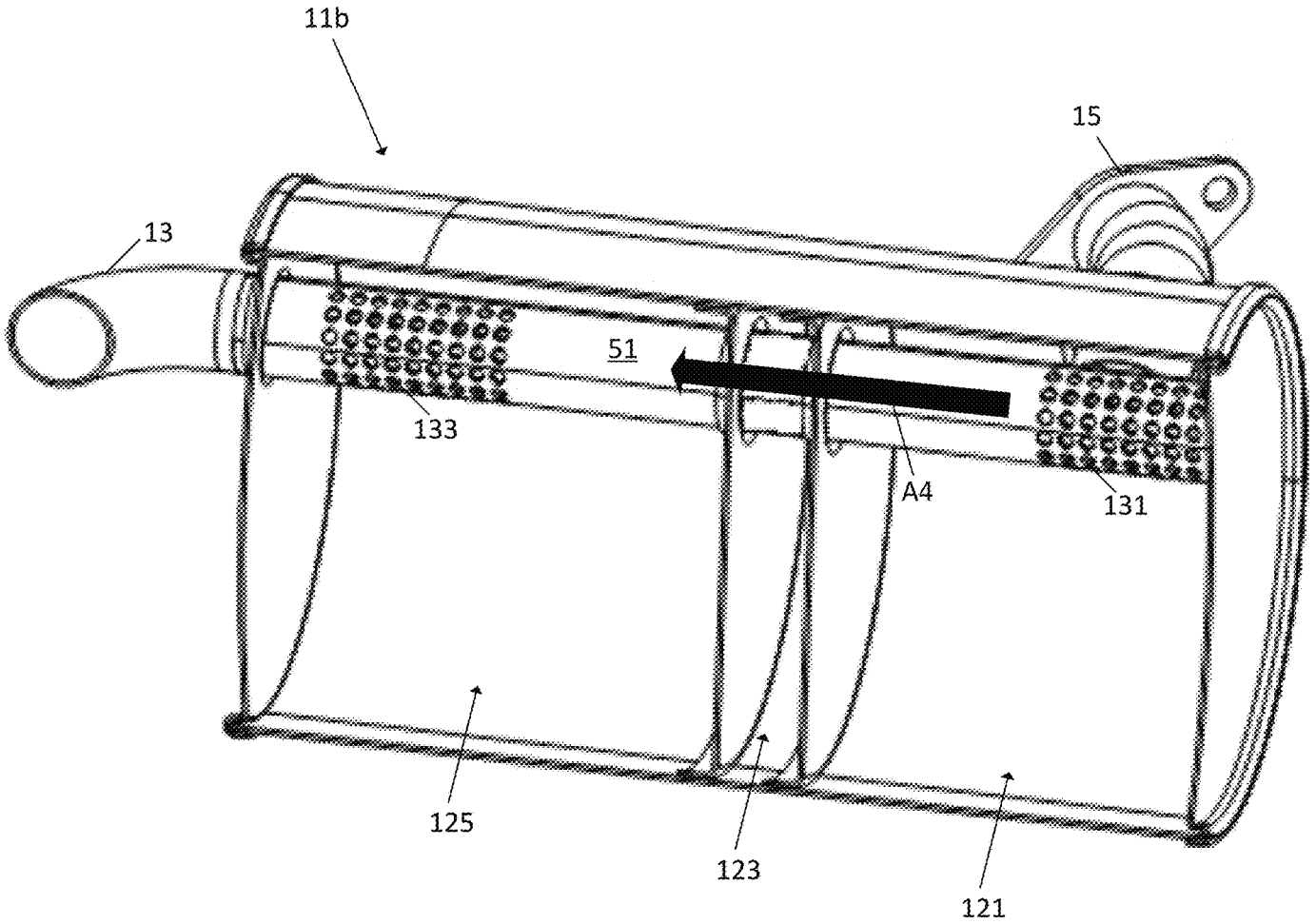
FIG. 5 illustrates another example muffler according to the second embodiment.

FIGS. 4 and 5 illustrate another embodiment. Muffler 11*b* includes first chamber 121, second chamber 125, and third chamber 123. Muffler 11*b* includes a single tube 51 that traverses the three chambers and facilitates the flow of exhaust gases as shown by arrow A4. One or more dimensions of the third chamber 123 may be selected according to the sound spectrum of the engine 10. The single tube 51 may be a quarter wave resonator with a length (L) that is tuned to $1/4^{th}$ of the frequency (f) of the pipe wavelength (e.g., f=c/4L where c represents the speed of sound). Additional, different or fewer components may be included.

The position of the tube 51 may be varied vertically or radially in any direction in the muffler 11*b*. In one example, the tube 51 is at or near the vertical center of the muffler 11*b*. In another example, the tube 51 may be slanted to an angle with the longitudinal axis of the muffler 11*b*. That is the input pipe 15 may be positioned at a different vertical height than the output tube 13. The tube 51 may extend to the housing of the muffler 11*b*. The tube 51 may be in contact with the end caps of the muffler 11*b*. In one example, the tube 51 includes one or more end caps that contact the housing. In another example, the tube 51 may be shorted at one end or both and not contact the housing.

The perforations 131 and 133 are illustrated in uniform arrangement. The perforations 131 and 133 may be evenly distributed over a portion of the tube 51. The axial length of the perforations may be minimized. A quantity of the perforations may be minimized to have the fewest perforations but still provide adequate flow for the exhaust gas.

The perforations reduce acoustic flow generated noise. The perforations apply an acoustic impedance boundary condition (e.g., according to Mechel's formula). This acoustic impedance increases the transmission loss slightly, particularly at higher frequencies. As the perforations are smaller, the acoustic impedance is higher accordingly, transmission loss increases.

Figure 7:
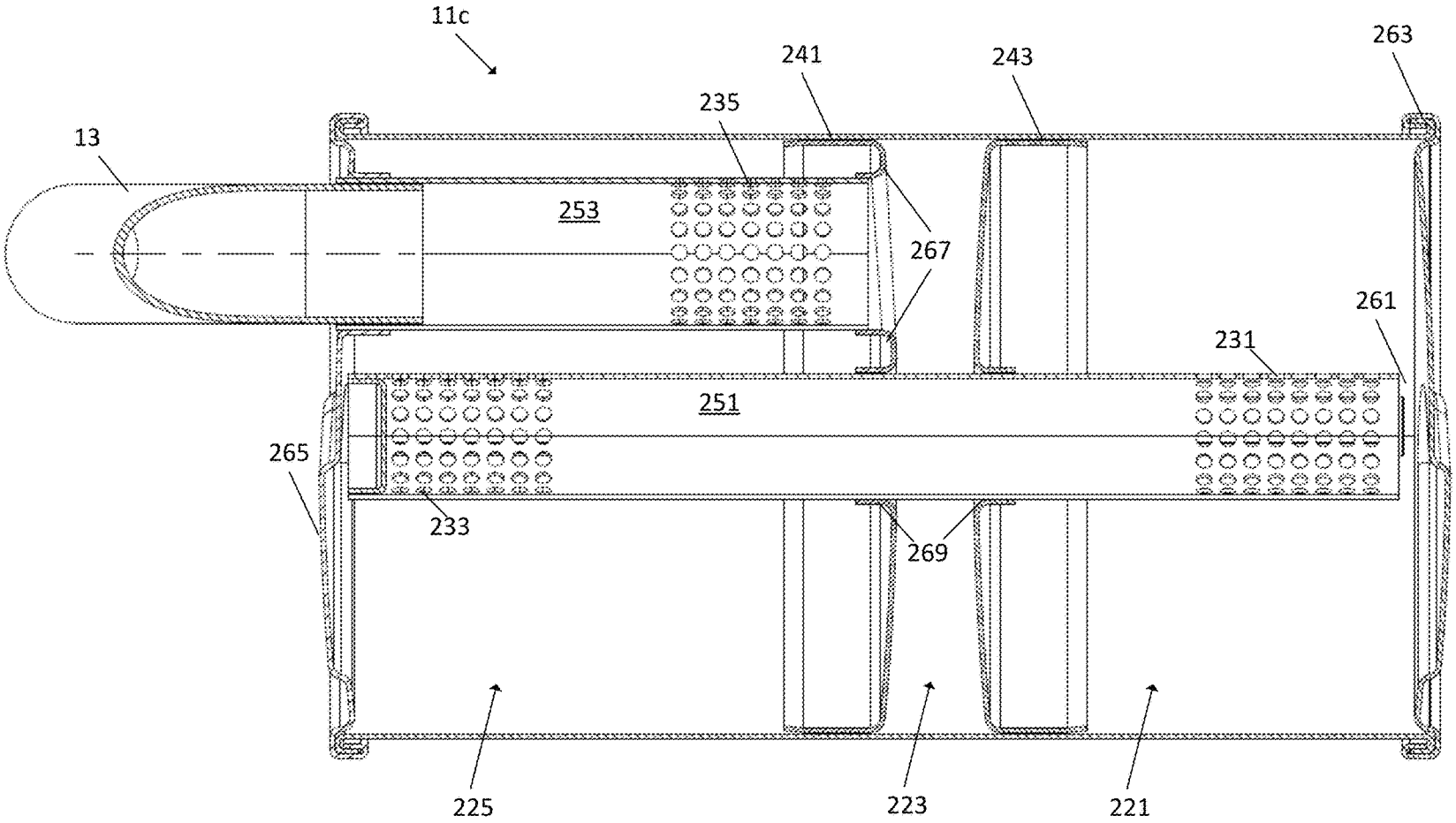
FIG. 7 illustrates another example muffler according to the third embodiment.
Figure 8:
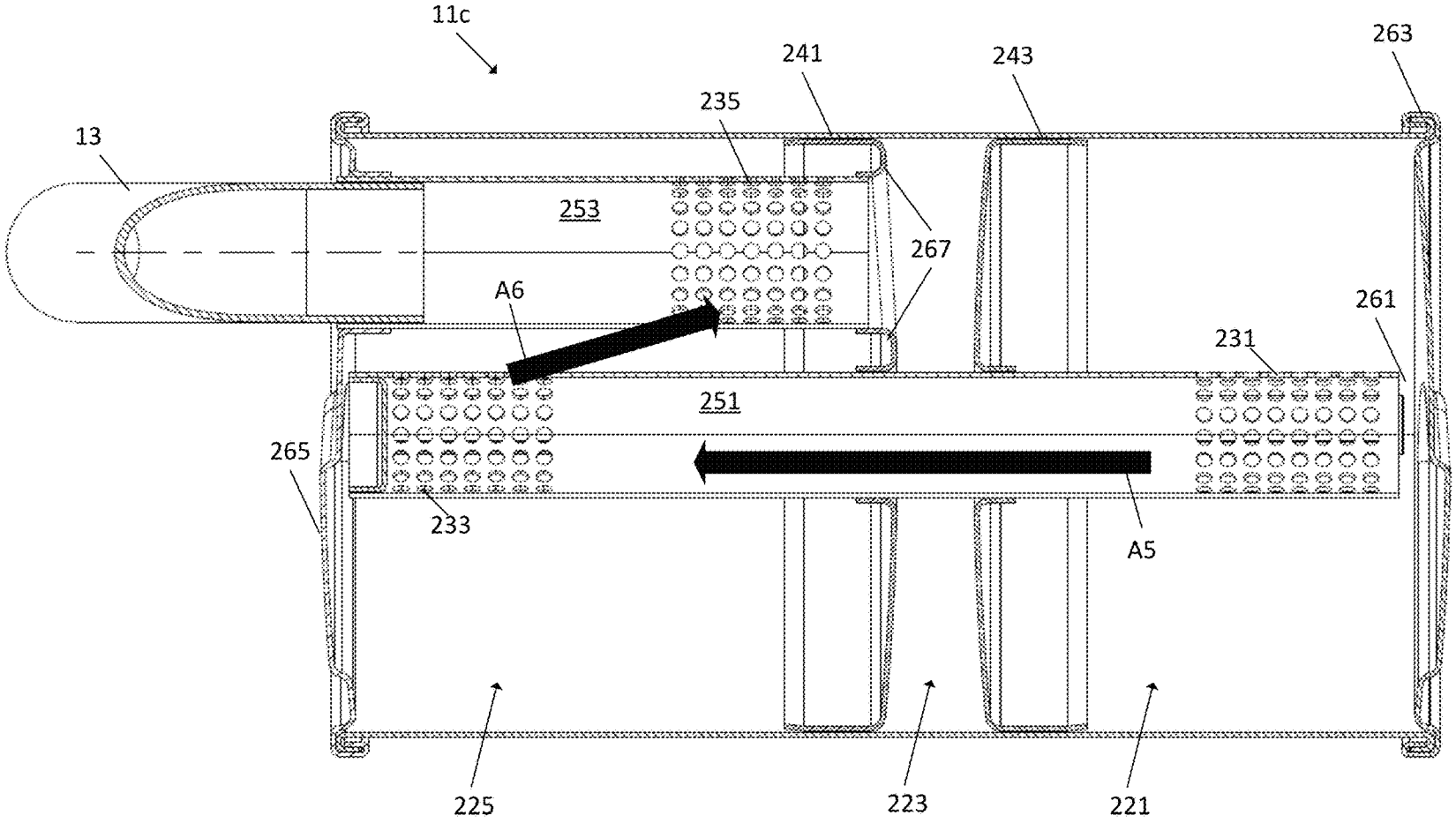
FIG. 8 illustrates another example muffler according to the third embodiment.

FIGS. 6, 7 and 8 illustrate another embodiment for a muffler 11*c*. FIG. 6 illustrates an exploded view of the muffler 11*c* including an input pipe 15, a seal 283, a flow bracket 285, a muffler bracket 281, and an output pipe 13. A housing 277 of the muffler 11*c* includes an input side baffle 243 including at least one opening (e.g., exactly one opening) and an output side baffle 241 including at least one opening (e.g., exactly one opening).

The sides of the housing 277 are closed by an upstream side end cap 263 and a downstream side end cap 265. The upstream side end cap 263 and the downstream side end cap 265 may include ridge members 264 that provide increased stiffness of the end caps and reduce ringing sounds from propagating through the upstream side end cap 263 and the downstream side end cap 265. The ridge members 265 may have an oblong shape or another shape. In addition, a ring 289 may provide additional sound buffering.

The seal 283 prevents exhaust, air or other gas from escapes the connection point between the input pipe 15 and the housing 277 of the muffler 11*c*. The seal 283 may also serve as additional material (e.g., steel) to weld the inlet pipe 15 to the housing 277. The muffler bracket 281 may include an opening for the input pipe 15. The muffler bracket 281 may receive screws or another fastener for securing the input pipe 15 and the housing 277 of the muffler 11*c* to the engine 10. The muffler bracket 281 may provide another coupling point between the engine 10 and the muffler 11*c*. Fasteners couple the muffler bracket 281 to the housing 277 and from the muffler bracket 281 to the engine 10.

FIG. 7 illustrates the internal components of the muffler 11*c* and housing 277. The muffler 11*c* includes at least three chambers or compartments including an upstream chamber 221 coupled to the exhaust inlet of the muffler 11*c*, a downstream chamber 225 coupled to the exhaust outlet of the muffler 11*c*, and a third chamber or a central chamber 223 between the downstream chamber 225 and the upstream chamber 221.

The dimensions of the central chamber 223 may be selected according to one or more frequencies of sounds produced by the engine 10. Alternatively, the dimensional of the central chamber 223 may be selected according to experimental testing (e.g., trial and error) of the attenuation performed by the muffler 11*c* at different sizes of the central chamber 223.

In the longitudinal direction of the muffler, a dimension of the central chamber 223 may be about 10 to 60 millimeters (e.g., 19.6 millimeters). When the central chamber 223 is cylindrically shaped, the dimension of the central chamber 223 in the longitudinal direction of the muffler is a height of the cylinder. The length of the central chamber 223 may be selected according to the overall length of the muffler 11*c*. The length of central chamber 223 may be a fraction of the length of the muffler 11*a*. The length of the central chamber 223 may be less than ⅙ (one sixth) of the overall length of the muffler 11*c*. Examples of fractions or ratios between the length of the central chamber 223 and the overall length of the muffler 11*a* may include ⅛, 1/12, or 1/20.

A first tube or extender tube 251 extends from the upstream chamber 221 through the central chamber 223 to the downstream chamber 225. The first tube 251 include a first set of openings 231 in communication with the upstream chamber 221 and a second set of openings 233 in communication with the downstream chamber 225.

The spacer ring 289 is in contact with the extender tube 251 and the downstream side end cap 265. The spacer ring 289 reduces sound waves or vibrations that travel between the extender tube 251 and the downstream side end cap 265. The spacer ring 289 may be sized too small to vibrate at the frequency range of the sound waves carried by the exhaust gas.

FIG. 8 illustrates the muffler 11*c* including arrows A5 and A6 for the direction of exhaust flow through the muffler 11*c*. The direction of the flow of air (first direction as shown by arrow A5) through the extender tube 251 is downstream from the exhaust inlet to the exhaust outlet. The first direction is a geometric direction substantially in the direction of a line drawn in the three dimensional space of the muffler 11*c* from the exhaust inlet to the exhaust outlet.

A second tube or a reverse flow tube 253 coupled to the downstream chamber 225. The reverse flow tube 253 includes a set of openings 235 and is coupled to the exhaust outlet for escaping the muffler 11*c*. The exhaust gas flows through the downstream chamber 225 from the extender tube 251 to the reverse flow tube 253. The direction of air flow (second direction as shown by arrow A6) from the extender tube 251 to the reverse flow tube is different than the direction of air from the exhaust inlet to the exhaust outlet. The second direction may be opposite to the first direction. The second direction may be substantially parallel to the first direction such as an internal angle is within 20 degrees. The second direction may include a substantial component that is parallel to the first direction. The second direction is a geometric direction substantially in the direction of a line drawn in the three dimensional space of the muffler 11*c* from the exhaust outlet to the exhaust inlet. The flow of air in the reverse flow tube 253 extends the distance of the flow of air from the exhaust inlet to the exhaust outlet. The flow of exhaust changes direction approximately 180 degrees in the flow of air from the exhaust to the exhaust outlet. Thus, the first direction is substantially parallel to and in an opposite direction to the second direction.

The exhaust inlet, from inlet pipe 15 may be spaced from the extender tube 251. The exhaust from the inlet pipe 15 may substantially fill the upstream chamber 221 before the gas enters the extender tube 251 through the first set of openings 231. The arrangement of the inlet pipe 15 and extender tube 251 may specify a predetermined pressure in the upstream chamber 221 before gas flows through the extender tube 251. Similarly, the set of openings 233 of the extender tube 251 is spaced from the set of openings 235 in the reverse flow tube 253. Thus, the exhaust from the extender tube 251 may substantially fill the downstream chamber 225 before the gas enters the reverse flow tube 251. The arrangement of the set of openings 233 and the set of openings 235 may specify a predetermined pressure in the downstream chamber 225 before gas flows into the reverse flow tube 251. Because the exhaust flow from the extender tube 251 fills the downstream chamber 225, pulses in the exhaust flow are further smoothed out over time.

The output side baffle 241 and the input side baffle 243 each include an opening 269 to receive the extender tube 251 and each opening 268 may include a collar for receiving and guiding the extender tube 251. In addition, the output side baffle 241 includes a flange 267 for receiving an end of the reverse flow tube 253. The flange 267 may include a collar or raised lip that extends above the output side baffle 241. The reverse flow tube 253 is supported by the flange 267 such that the reverse flow tube 253 contacts the output side baffle 241, and the reverse flow tube 253 does not pass through the second baffle.

The extender tube 251 may be spaced from end cap 263 by spacing 261. The spacing 261 may be in the range of 1 to 100 millimeters. Examples include 5, 10, and 13 millimeters. In other examples, the spacing 261 is omitted (e.g., spacing of 0 millimeters).

A length of the extender tube 251 may be in the range of 100 to 400 millimeters, or preferably 225 to 275 millimeters (e.g., 254 millimeters). The length of the extender 251 may impact the low frequency attenuation effect of the central chamber 223. Additional length may provide additional attenuation. A length of the reverse flow tube 253 may be in the range of the 50 to 200 millimeters, or preferably 125 to 175 millimeters (e.g., 134 millimeters). The length of the reverse flow tube 253 may be approximately half of the length of the extender tube 251.

The length of the central chamber 223 may be less than a quarter wavelength of sound waves from the engine 10 coupled to the muffler 11*c*. That is, the central chamber 223 may be sized too small to act as a quarter wave resonator, Helmholtz resonator or Helmholtz oscillator. Thus, each substantial frequency of the sound waves produced by the engine 10 through mechanical movements (low frequency range) is less than the resonant frequency of a Helmholtz resonator having the dimensions of the central chamber. Substantial frequency components are frequency components making up a threshold power (e.g., power level in dB or percentage of the total power) in the frequency spectrum of the sound of the engine 10. Dominant frequency components are above the threshold power level in the frequency spectrum. The substantial frequency components may be a set of predetermined frequencies of the sound of the engine 10.

In one example, the dimensions for the central chamber 223 may be determined according to a size factor (sf) defined from the substantial frequency as described in Equation 1:

$$sf = \sqrt{\frac{A}{V * L}}, \qquad \text{Eq. 1}$$

such that A is opening area of the central chamber 223 connected to the extender tube 251, V is a volume of the central chamber 223, and L is a length of the extender tube 251.

The dimensions of the central chamber 223 may be selected such that the resonant frequency of the quarter wave resonator is out of the range of the substantial frequency components of the engine 10. Equation 2 defines the resonate frequency (f) of the chamber according to the speed of sound as a function of temperature (c) and the wavelength chamber length (λ). Using equation 2, consider an example with c=500 m/s and λ=19.6 mm. Then the quarter wavelength resonance frequency of this chamber is 6.4 kHz. This frequency is too high to be useful for noise attenuation in this muffler. Thus, the quarter wave resonant frequency is this example chamber is out of the range of substantial frequency components of the engine 10 and a length of the central chamber 223 is less than a quarter wavelength of sound waves of a set of predetermined frequencies from an engine coupled to the muffler.

$$f = \frac{c}{4 * \lambda} \quad \text{Eq. 2}$$

Figure 9:
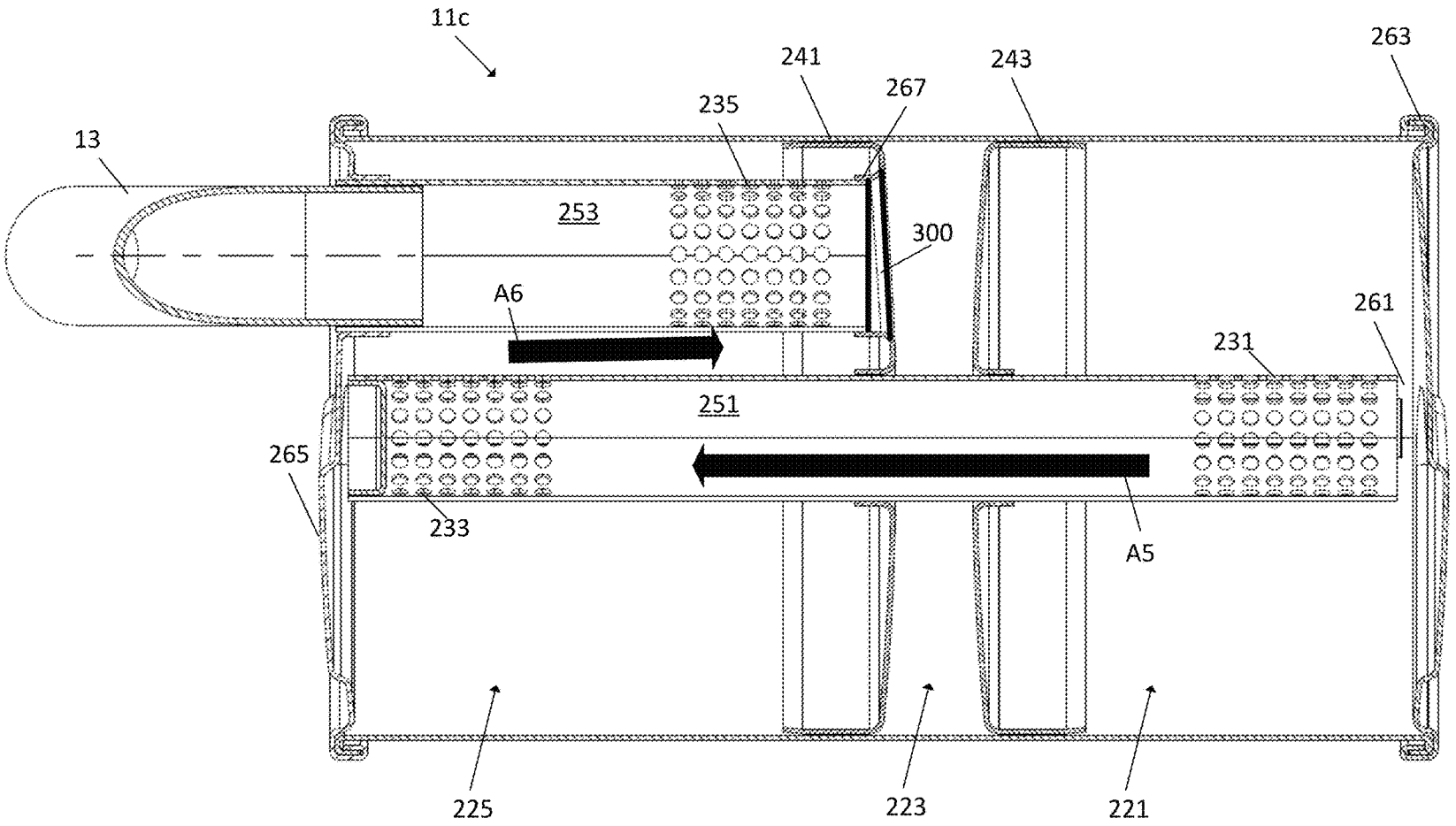
FIG. 9 illustrates another example muffler according to the third embodiment.

FIG. 9 illustrates another example for the muffler 11*c*. Like reference numerals in FIG. 9 describe the same components perform in substantially the same manner as the examples of FIGS. 7 and 8. FIG. 9 includes a cap 300 for the reverse flow tube 253. The cap 300 blocks the flow of gas from entering the central chamber 223. The cap 300 may be fixed on the end of reverse flow tube 253. The cap 253 may screw into the flange 267.

In one example, the cap 253 may include a valve biased into a closed position by a spring. The valve moves in response to the pressure of the gas in the reverse flow tube 253. As the pressure of the gas increases the valve moves to an increasingly open position. The bias force in the spring of the valve may be selected according to a load on the engine 10. When the load is above a threshold, the valve is opened to allow gas into the central chamber 223. When the load is below the threshold, the valve remains closed.

Figure 10:
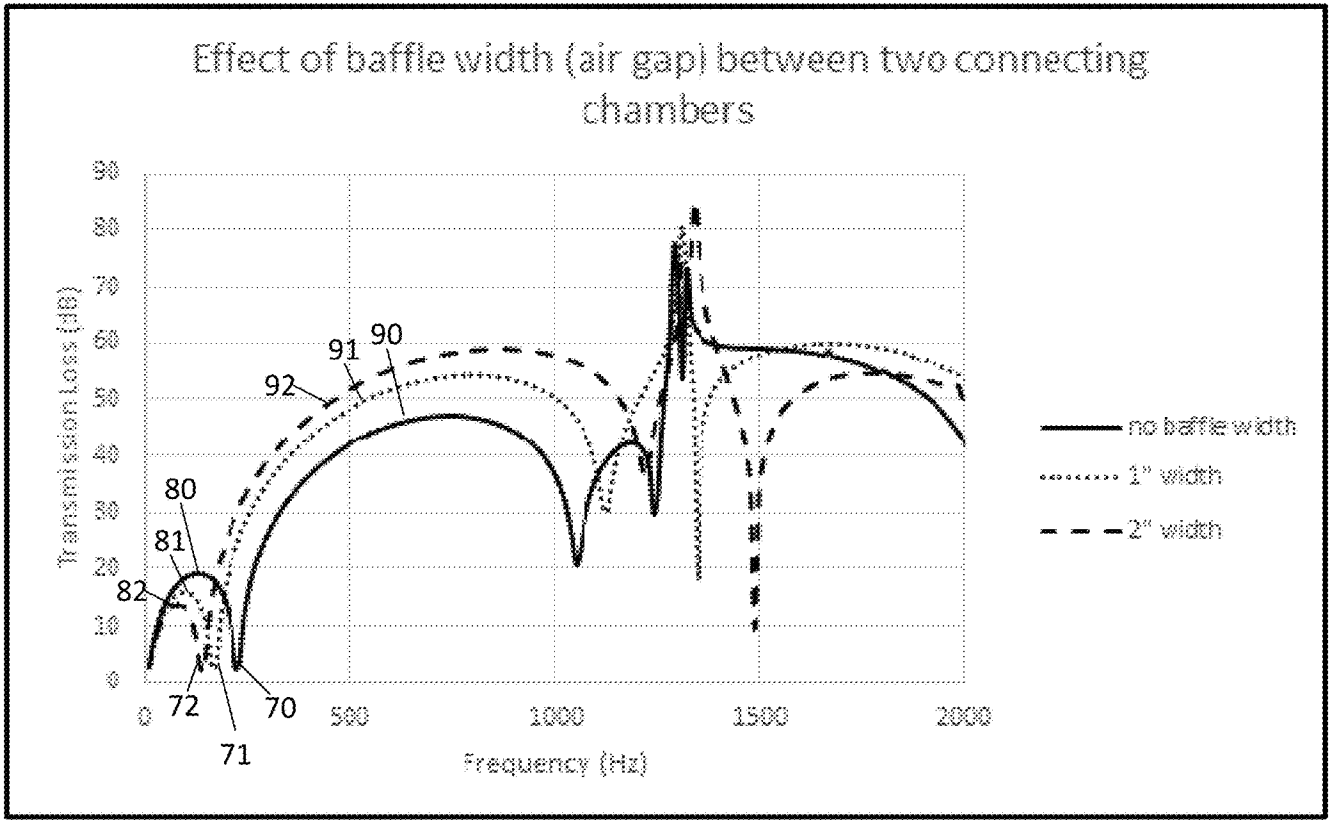
FIG. 10 illustrates a chart for the sound attenuation performance of the muffler according to the first through third embodiments.

FIG. 10 illustrates the sound attenuation performance of a muffler including the third chamber described herein. The combustion noise of an engine may include low frequencies such as below 200 Hz or 100 Hz. The solid line in FIG. 6 illustrates the performance of a muffler without a third chamber, the dotted line illustrates the performance of the same muffler with a third chamber having a first thickness (small thickness), and the dashed line illustrates the performance of the same muffler with a third chamber having a second thickness (large thickness).

The solid line includes a trough 70 corresponding to a local low amount of attenuation, and mound 80 corresponding to a local high amount of attenuation. The dotted line illustrates that the trough 70 is moved to trough 71 and the mound 80 is moved to mound 81 with lower frequencies when the third chamber is added. The lower frequencies better match the combustion noises of the engine. The difference between the troughs 70 and 80 and the difference between mounds 71 and 81 may be calculated as a function of the thickness of the third chamber. Accordingly, the dash line illustrates that the trough 70 is moved to trough 72 and the mound 80 is moved to mound 82 with lower frequencies when a larger third chamber is added.

In addition, increased attenuation performance is attained in a higher frequency range. The higher frequency range may be 500 to 1000 Hz. FIG. 6 illustrates that the dotted line for the first thickness of the third chamber corresponds to higher attenuation at mound 91 compared to mound 90 when no third chamber is used. Similarly, the dashed line for the second thickness of the third chamber corresponds to even higher attenuation at mound 92.

Figure 11:
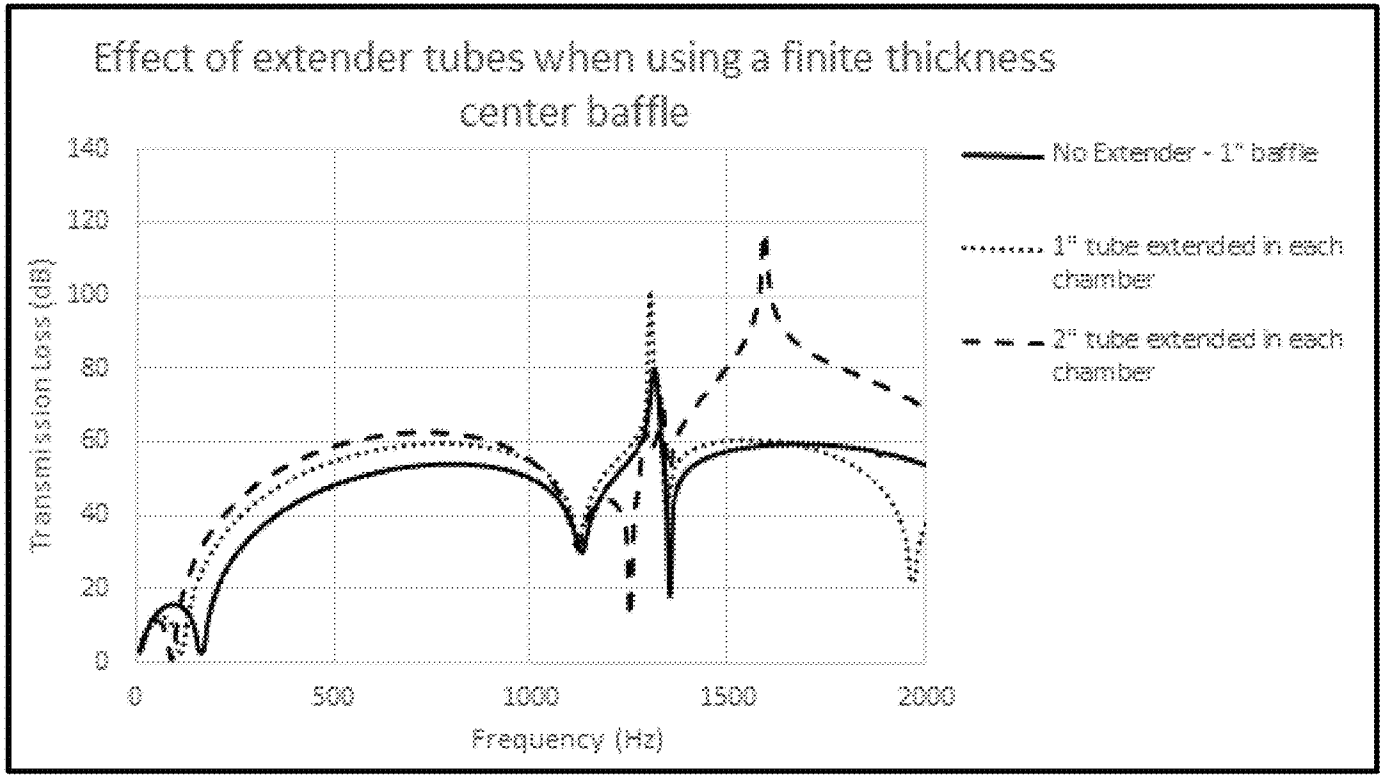
FIG. 11 illustrates a chart for the sound attenuation performance of the muffler according to the first through third embodiments.

FIG. 11 illustrates the attenuation of the muffler using a single thickness and an extender tube (e.g., tube 51) traverses two or more of the chambers in the muffler. In this example, the solid line corresponds to a third chamber having a one inch thickness, which is similar to the dotted line in FIG. 6. The dotted line corresponds to the same third chamber with the extender tube added. FIG. 7 illustrates that the addition of the extender tube causes the mound for the lowest frequency to shift to lower frequencies (e.g., below 100 Hz) and increase the attenuation at higher frequencies (e.g., between 500 and 1000 Hz). Without the spatial separation between the first chamber 21 and second chamber 25, the extender tubes (e.g., tube 51) would have little to no effect on low frequency transmission loss.

Figure 12:
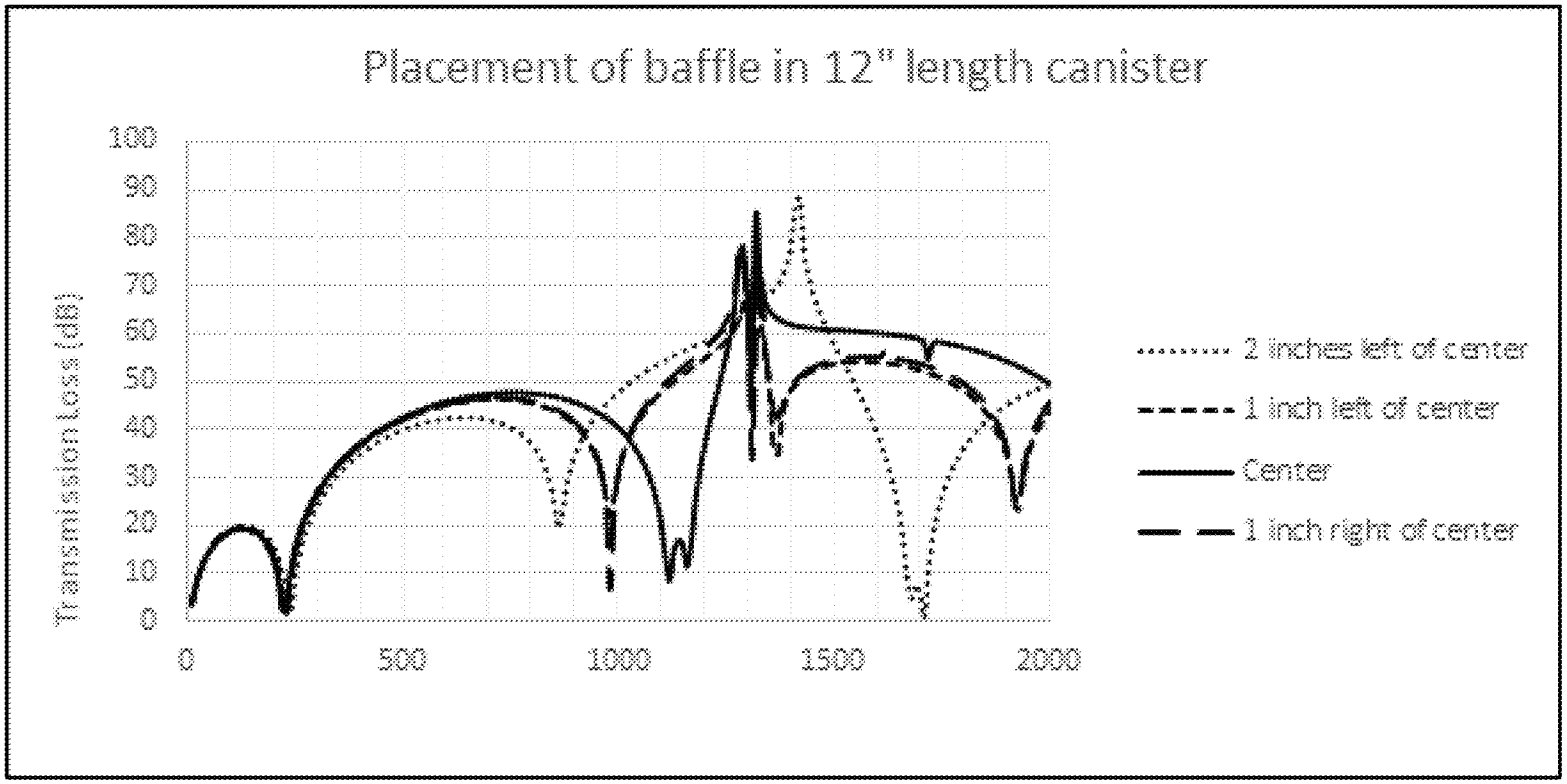
FIG. 12 illustrates a chart for the sound attenuation performance of the muffler according to the first through third embodiments.
Figure 13:
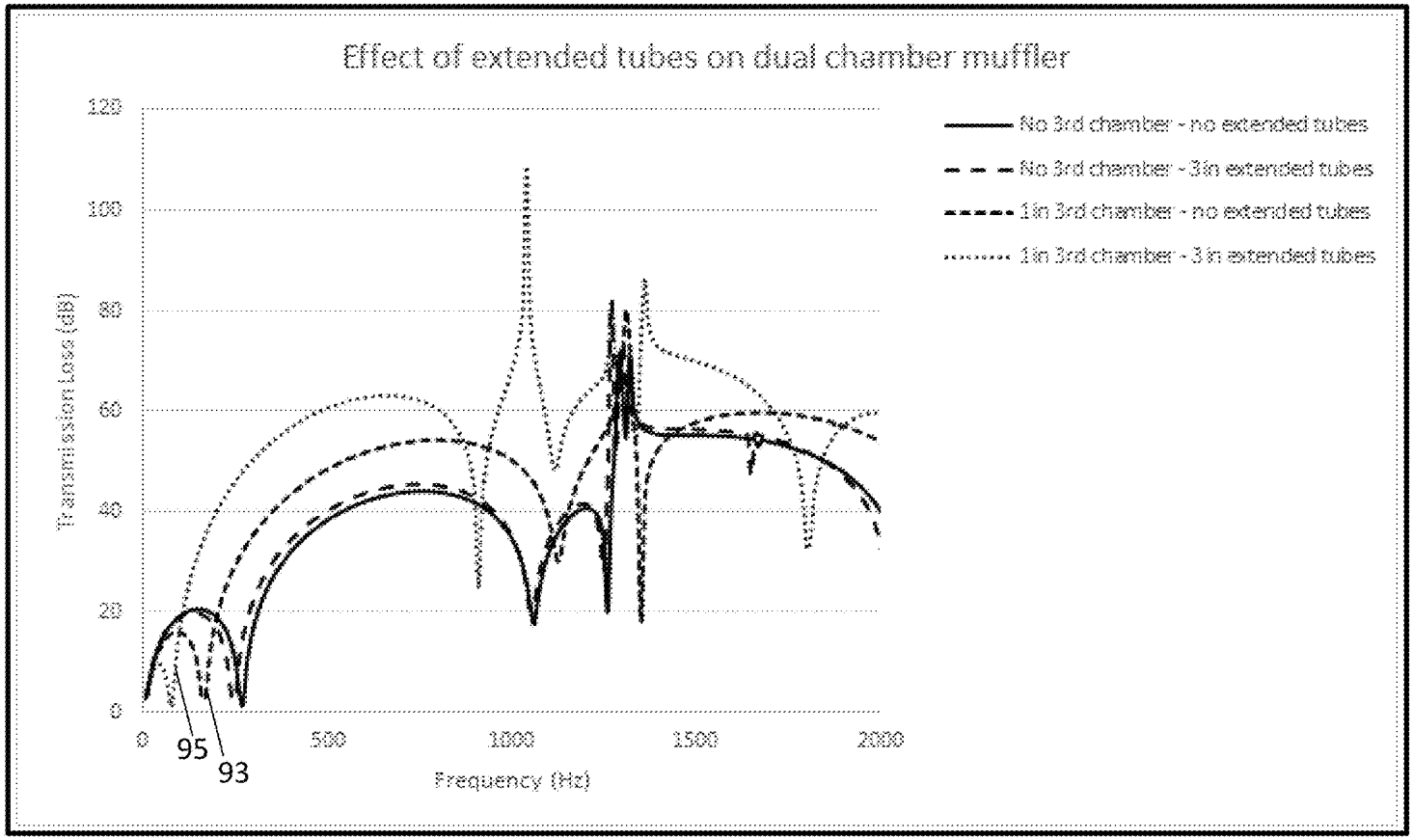
FIG. 13 illustrates a chart for the sound attenuation performance of the muffler according to the first through third embodiments.

FIG. 12 illustrates the lateral placement of the third chamber in the canister of the muffler. Positioning the baffle near the center of the chamber will most likely yield the highest transmission Loss, particularly in the mid-frequency range (e.g., 200-1000 Hz). A dual-chamber muffler has a small mound shape in the low frequency range, followed by a larger mound shape. The second mound shape is what is most effected by baffle placement for a dual-chamber muffler.

The shape of the transmission loss plot may be dependent on where the inlet (e.g., input pipe 15) is located on the muffler. This effect may be particularly present at the higher frequencies. The muffler inlet length may operate as a quarter wave resonator. The shape of the transmission loss plot may be changed based on the shape of the muffler. The overall length of the muffler may impact the low frequency attenuation capacity. The transmission loss "mound" shape may be governed by this length. The muffler diameter may impact the attenuation capacity and/or height of these "mound" shapes. This is dependent on frequency, but generally true for the low-to-middle range frequencies (e.g., 100-1000 Hz). For a two chamber muffler (with or without the air gap separating the chambers), the ideal ratio may be at or near to 50/50.

FIG. 12 illustrates simulations to illustrate that the third chamber or spatial separating chamber has an added benefit when using extended tubes. Extended tubes have little to no effect on the mid-to-low frequency range without the third chamber or separation. The mound, or corresponding trough, that represents the loss of the lowest frequency moves lower when the spatial separating chamber is included, as shown by the smaller dash line 93, and even lower when the extender tube is included in combination with the spatial separating chamber, as shown by the dotted 95.

Figure 14:
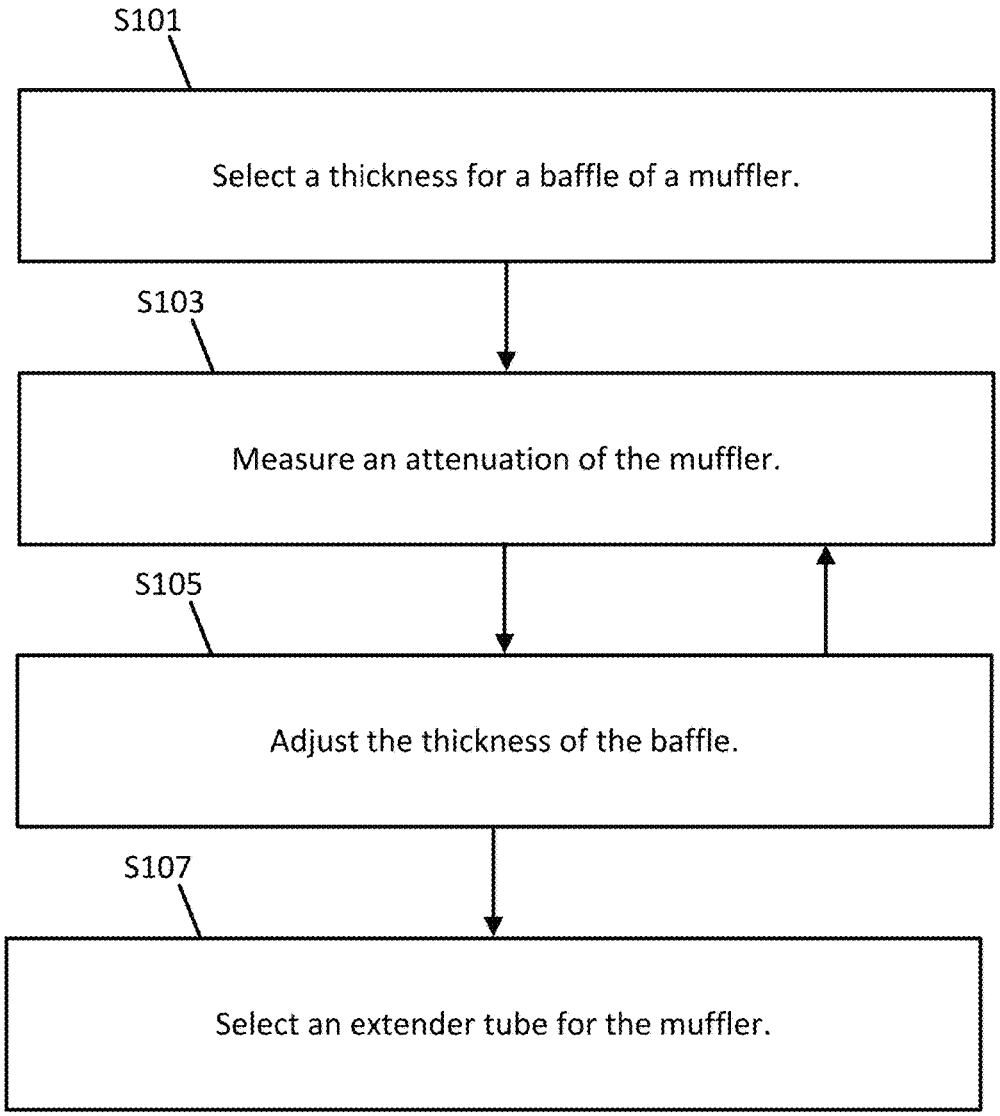
FIG. 14 illustrates an example flowchart for operation of the muffler.

FIG. 14 illustrates an example flowchart for defining the third chamber according to the first, second, or third embodiments of the muffler described herein. Additional, different, or fewer acts may be provided. The acts are performed in the order shown or other orders. The acts may also be repeated.

At act S101, a thickness is selected for the baffle or third chamber of the muffler. The third chamber may be formed by two baffles having empty space or air between. On either side of the baffle or third chamber is an exhaust containing chamber that facilitates the flow of exhaust from the inlet of the muffler to the outlet.

At act S103, the attenuation of the muffler is measured or predicted at the first thickness. The attenuation may be measured using a microphone comparing the acoustic output of the engine without the muffler connected to the acoustic output of the engine with the muffler connected.

At act S105, the thickness of the baffle or third chamber is adjusted. The thickness of the baffle may be increased by adding plates that are sandwiched together. The thickness of a third chamber containing empty space or air may be increased by moving one of the baffles for the third chamber. Act S103 and S105 may be repeated until the attenuation of successive measurements increases in order to identify the optimal thickness. At act S107, an extender tube may be selected after the optimal thickness for the baffle or the third chamber is determined. The extender tube length can also be varied to yield optimal attenuation.

The acts of FIG. 14 may be performed by one or more controllers including a specialized processor, one or more memories and a communication interface. Instructions for the one or more controllers may be embodied on a non-transitory computer readable medium.

Figure 15:
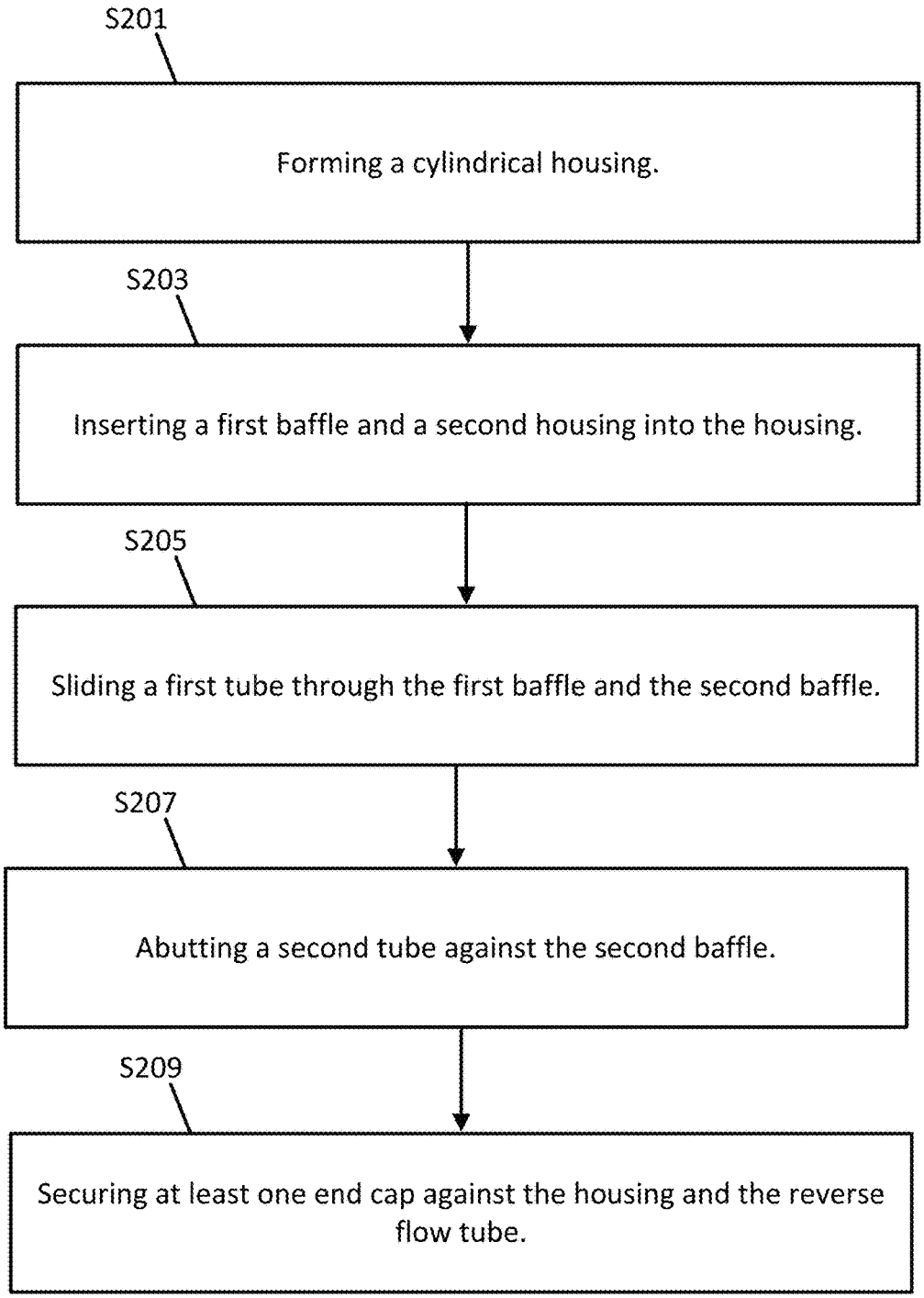
FIG. 15 illustrates an example flowchart for manufacturing the muffler.

FIG. 15 illustrates an example flowchart for manufacturing the mufflers according to the first, second or third embodiments of the muffler described herein. Additional, different, or fewer acts may be provided. The acts are performed in the order shown or other orders. The acts may also be repeated.

Act S201 includes forming a cylindrical housing (e.g., housing 277). The housing may be formed from a single piece of metal (e.g., steel or aluminum) that is formed into a cylinder and affixed to itself. One end of the piece of metal may be welded or otherwise secured to another end of the piece of metal. The piece of metal may be heated to facilitate changing the shape of the metal.

Act S203 includes inserting a first baffle (e.g., input side baffle 243) and a second baffle (e.g., output side baffle 241) into the cylindrical housing. The baffles may include one or more openings. The baffles may include a flat face that is inserted to the interior of the housing such that the flat face of the first baffle faces the flat face of the second baffle. An open face of each baffle may face away from the cylinder of the housing.

Act S205 includes sliding a first tube (e.g., extender tube 251) through the first baffle and the second baffle. One or both of the first baffle and the second baffle may include a collar for guiding the first tube through the opening in the baffle. The first tube may have been formed from punching holes in an open ended pipe. The holes may be arranged in various patterns over a predetermined portion (e.g., ¼) of the tube. In some examples, acts S205 is performed before S203 and the first tube combined with the first baffle and/or the second baffle is inserted together into the cylindrical housing.

Act S207 includes abutting a second tube (e.g., reverse flow tube 253) against the second baffle. The second baffle may include an indentation or a collared flange for receiving the second tube. The second tube may be formed from punching holes in various patterns over a predetermined portion of the tube. Act S209 includes securing at least one end cap (e.g., both against the housing and the reverse flow tube. Both upstream side end cap 263 and a downstream side end cap 265.

The illustrations of the embodiments described herein are intended to provide a general understanding of the structure of the various embodiments. The illustrations are not intended to serve as a complete description of all of the elements and features of apparatus and systems that utilize the structures or methods described herein. Many other embodiments may be apparent to those skilled in the art upon reviewing the disclosure. Other embodiments may be utilized and derived from the disclosure, such that structural and logical substitutions and changes may be made without departing from the scope of the disclosure. Additionally, the illustrations are merely representational and may not be drawn to scale. Certain proportions within the illustrations may be exaggerated, while other proportions may be minimized. Accordingly, the disclosure and the figures are to be regarded as illustrative rather than restrictive.

While this specification contains many specifics, these should not be construed as limitations on the scope of the invention or of what may be claimed, but rather as descriptions of features specific to particular embodiments of the invention. Certain features that are described in this specification in the context of separate embodiments can also be implemented in combination in a single embodiment. Conversely, various features that are described in the context of a single embodiment can also be implemented in multiple embodiments separately or in any suitable sub-combination. Moreover, although features may be described above as acting in certain combinations and even initially claimed as such, one or more features from a claimed combination can in some cases be excised from the combination, and the claimed combination may be directed to a sub-combination or variation of a sub-combination.

Similarly, while operations are depicted in the drawings and described herein in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the embodiments described above should not be understood as requiring such separation in all embodiments, and it should be understood that the described program components and systems can generally be integrated together in a single software product or packaged into multiple software products.

One or more embodiments of the disclosure may be referred to herein, individually and/or collectively, by the term "invention" merely for convenience and without intending to voluntarily limit the scope of this application to any particular invention or inventive concept. Moreover, although specific embodiments have been illustrated and described herein, it should be appreciated that any subsequent arrangement designed to achieve the same or similar purpose may be substituted for the specific embodiments shown. This disclosure is intended to cover any and all subsequent adaptations or variations of various embodiments. Combinations of the above embodiments, and other embodiments not specifically described herein, will be apparent to those of skill in the art upon reviewing the description.

It is intended that the foregoing detailed description be regarded as illustrative rather than limiting and that it is understood that the following claims including all equivalents are intended to define the scope of the invention. The claims should not be read as limited to the described order or elements unless stated to that effect. Therefore, all embodiments that come within the scope and spirit of the following claims and equivalents thereto are claimed as the invention.

I claim:

1. A muffler including:

a first chamber coupled to an exhaust inlet of the muffler;

a second chamber;

an extender tube coupled to the first chamber and the second chamber, wherein an exhaust gas flows from the first chamber to the second chamber through the extender tube in a first direction;

a separation chamber that provides spatial separation between the first chamber and the second chamber; and a reverse flow tube coupled to the second chamber and the separation chamber, wherein the exhaust gas flows through the second chamber from the extender tube to a first set of perforations on a circumference of the reverse flow tube in a second direction different than the first direction, and wherein the first set of perforations are disposed in the separation chamber and the second chamber.

2. The muffler of claim 1, wherein the exhaust gas flows through the second chamber from a second set of perforations on a circumference of the extender tube to the first set of perforations on the circumference of the reverse flow tube.

3. The muffler of claim 1, wherein the first direction is substantially parallel to and in an opposite direction to the second direction.

4. The muffler of claim 1, further comprising:

a first baffle adjacent to the first chamber; and a second baffle adjacent to the second chamber, wherein the extender tube traverses the separation chamber by passing through the first baffle and the second baffle.

5. The muffler of claim 4, wherein the first baffle includes a first opening for the extender tube and the second baffle includes a second opening for the extender tube.

6. The muffler of claim 4, wherein the second baffle includes a receiving flange for the reverse flow tube, wherein the reverse flow tube abuts the second baffle.

7. The muffler of claim 6, wherein the reverse flow tube does not pass through the second baffle.

8. The muffler of claim 1, further comprising:

an outlet tube coupled to the reverse flow tube and configured to expel the exhaust gas flows away from the muffler.

9. The muffler of claim 1, wherein the separation chamber includes one or more baffles having a predetermined thickness.

10. The muffler of claim 1, wherein the separation chamber is sealed from the first chamber, the second chamber, or both and does not include the exhaust gas.

11. The muffler of claim 1, wherein the separation chamber receives the exhaust gas from the first set of perforations of the reverse flow tube.

12. The muffler of claim 11, wherein the separation chamber is sealed from the first chamber and the second chamber except for the reverse flow tube.

13. The muffler of claim 1, wherein the separation chamber creates an impedance mismatch between the first chamber and the second chamber.

14. The muffler of claim 13, wherein the impedance mismatch attenuates low frequencies sounds.

15. The muffler of claim 1, wherein a length of the separation chamber is less than a quarter wavelength of sound waves at a set of predetermined frequencies from an engine coupled to the muffler.

16. The muffler of claim 1, wherein the exhaust inlet of the muffler is spaced from the extender tube by a predetermined distance, wherein a space from the predetermined distance spreads exhaust pulses over time.

17. A method comprising:

forming a cylindrical housing including a first chamber and a second chamber;

inserting a first baffle and a second baffle into the cylindrical housing;

sliding an extender tube through the first baffle and the second baffle to form a separation chamber between the first baffle and the second baffle, wherein exhaust gas flows from the first chamber to the second chamber through the extender tube from a first set of perforations on a circumference of the extender tube in the first chamber to a second set of perforations on the circumference of the extender tube in the second chamber in a first direction; and abutting a reverse flow tube against the second baffle, wherein the exhaust gas flows through the second chamber from the second set of perforations of the extender tube to the reverse flow tube in a second direction different than the first direction.

18. The method of claim 17, further comprising:

securing an end cap against the cylindrical housing and the reverse flow tube.

19. An engine comprising:

at least one cylinder shaped to receive a piston;

a combustion chamber that generates a force to move the piston and an exhaust gas; and a muffler comprising:

a first chamber coupled to an exhaust inlet of the muffler;

a second chamber;

an extender tube coupled to the first chamber and the second chamber, wherein the exhaust gas from the first chamber to the second chamber flows through the extender tube in a first direction;

a reverse flow tube coupled to the second chamber, wherein the exhaust gas flows through the second chamber from the extender tube to the reverse flow tube in a second direction different than the first direction; and a separation chamber that provides spatial separation between the first and second chamber, wherein the separation chamber is sealed from the exhaust gas.

20. The engine of claim 19, wherein a length of the separation chamber is less than a quarter wavelength of sound waves at a set of predetermined frequencies from the engine.

* * * * *